US007801467B2

(12) United States Patent
Uno et al.

(10) Patent No.: US 7,801,467 B2
(45) Date of Patent: Sep. 21, 2010

(54) DEVELOPING-AGENT CONTAINER, METHOD OF MANUFACTURING DEVELOPING-AGENT CONTAINER, DEVELOPING-AGENT SUPPLYING DEVICE, AND IMAGE FORMING APPARATUS

(75) Inventors: Mugijirou Uno, Kanagawa (JP); Hiroyuki Okaji, Kanagawa (JP); Keiko Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 11/842,659

(22) Filed: Aug. 21, 2007

(65) Prior Publication Data

US 2008/0063434 A1 Mar. 13, 2008

(30) Foreign Application Priority Data

Sep. 11, 2006 (JP) ..... 2006-245871

(51) Int. Cl.
*G03G 15/08* (2006.01)

(52) U.S. Cl. ..... 399/258; 399/259

(58) Field of Classification Search ..... 399/119, 399/120, 252, 257, 258, 262, 259; 222/DIG. 1
See application file for complete search history.

(56) References Cited

U.S. PATENT DOCUMENTS 5,666,625 A 9/1997 Komatsubara et al.
5,689,782 A 11/1997 Murakami et al.
6,146,801 A * 11/2000 Ichikawa et al. ..... 430/111.35
6,858,365 B2 2/2005 Sawada et al.
7,050,741 B2 * 5/2006 Koike et al. ..... 399/159
7,184,691 B2 * 2/2007 Kita et al. ..... 399/119
2007/0116494 A1 5/2007 Uno et al.

FOREIGN PATENT DOCUMENTS

| | | |
|---|---|---|
| JP | 9-319161 | 12/1997 |
| JP | 2837309 | 10/1998 |
| JP | 2002-14509 | 1/2002 |
| JP | 2003-345115 | * 12/2003 |
| JP | 2004-29306 | 1/2004 |
| JP | 2005-250456 | 9/2005 |
| JP | 3920705 | 2/2007 |

OTHER PUBLICATIONS

U.S. Appl. No. 12/253,538, filed Oct. 17, 2008, Uno, et al.
U.S. Appl. No. 12/246,027, filed Oct. 6, 2008, Uno, et al.
U.S. Appl. No. 12/114,164, filed May 2, 2008, Matsumoto, et al.
U.S. Appl. No. 12/138,802, filed Jun. 13, 2008, Uno, et al.

* cited by examiner

*Primary Examiner*—Hoan Tran
(74) *Attorney, Agent, or Firm*—Oblon, Spivak, McClelland, Maier & Neustadt, L.L.P.

(57) ABSTRACT

A developing-agent container contains a developing agent to be supplied to a developing unit. The developing agent contains toner and carrier. The developing-agent container is filled with the developing agent with the toner and the carrier evenly distributed in a highly air-containing state. After filling the developing-agent container with the developing agent, an external force is applied on at least one of the toner and the carrier in the toner container so that a difference in forces per unit volume of the toner and the carrier due to gravity becomes small.

20 Claims, 9 Drawing Sheets

DEVELOPING-AGENT CONTAINER, METHOD OF MANUFACTURING DEVELOPING-AGENT CONTAINER, DEVELOPING-AGENT SUPPLYING DEVICE, AND IMAGE FORMING APPARATUS

CROSS-REFERENCE TO RELATED APPLICATIONS

The present application claims priority to and incorporates by reference the entire contents of Japanese priority document, 2006-245871 filed in Japan on Sep. 11, 2006.

BACKGROUND OF THE INVENTION

1. Field of the Invention

The present invention relates to a developing-agent container, a method of manufacturing the developing-agent container, a developing-agent supplying device, and an image forming apparatus.

2. Description of the Related Art

Image forming apparatuses with a developing unit that uses a two-component developing agent including a toner and a magnetic carrier are widely used. In such types of image forming apparatuses, as the toner in the developing agent gets consumed, fresh toner is supplied from a toner container to the developing agent in the developing unit, thus maintaining the concentration of the toner in the developing agent within a predetermined range. However, the carrier in the developing agent remains mostly unconsumed, and is used repeatedly. Consequently, with continued image output, the top layer or the coating layer of the carrier gets abraded or, conversely, toner resin or additive particles adhere to the top layer of the carrier. This results in a progressive decline in the ability of the carrier to charge the toner and a subsequent degradation of the carrier. As the carrier continues to degrade, the charge of the toner diminishes, resulting in banding and toner scattering. Consequently, a maintenance personnel needs to be periodically called to replace the carrier, resulting in increased cost per copy.

Japanese Patent No. 2837309 and Japanese Patent Application Laid-open No. 2004-29306 disclose image forming apparatuses in which a premixed developing agent, which is a mixture of carrier and toner, is added to the developing agent in the developing unit to replenish the concentration of the toner, and surplus developing agent is drained from the developing unit. Spent carrier from the developing agent is drained little by little from the developing unit and fresh carrier in the premixed developing agent is added to the developing agent in the developing unit. Thus, the need for entirely replacing the carrier can be obviated by draining the spent carrier and supplying fresh carrier little by little.

However, before filling the developing-agent container with the premixed developing agent to be supplied to the developing unit, the toner and the carrier are mixed so that the toner particles and the carrier particles are evenly distributed. In spite of that, the proportion of the carrier particles at the bottom of the container tends to be greater accounting for uneven distribution of the toner particles and the carrier particles. This is because a significant amount of air also gets incorporated in the premixed developing agent when it is filled in the developing-agent container. After some time, the bulk of the premixed developing agent settles when the air is expelled from it. During the settling process, the carrier particles sink to the bottom faster than the toner particles because the specific gravity of the carrier particle is greater than that of the toner particle, leading to uneven distribution of the toner particles and the carrier particles.

The developing-agent container now contains a premixed developing agent having unevenly distribution toner particles and carrier particles, and when this premixed developing agent is added to the developing agent in the developing unit, the toner-to-carrier ratio of the premixed developing agent will vary from time to time. If a premixed developing agent having carrier in greater proportion is added to the developing agent, control over toner density will become unsteady leading to a faulty image. If a premixed developing agent having toner in greater proportion is added to the developing agent, the spent carrier in the developing unit fails to be replenished, leading to carrier degradation and therefore a faulty image.

Degradation of even distribution of the toner and the carrier can also pose a problem when the user fits the developing-agent container in the image forming apparatus. Specifically, the user usually shakes the developing-agent container well to obtain evenly distributed toner and carrier before fitting the developing-agent container in the image forming apparatus. The shaking incorporates air in the developing agent within the developing-agent container. However, after some time, the bulk of the developing agent settles by expelling the trapped air. The high specific gravity carrier particles sink to the bottom faster than the low specific gravity toner particles, leading to uneven distribution of the toner particles and the carrier particles.

Uneven distribution of the toner particles and the carrier particles can also result when a toner having a greater specific gravity than the carrier is used, in which case, the proportion of the toner particles at the bottom will be greater.

SUMMARY OF THE INVENTION

It is an object of the present invention to at least partially solve the problems in the conventional technology.

A method according to one aspect of the present invention is for manufacturing a developing-agent container for containing developing agent containing toner and carrier to be supplied to a developing unit. The method includes filling the developing-agent container with the developing agent with the toner and the carrier evenly distributed in a highly air-containing state; and applying, after filling the developing-agent container with the developing agent, an external force on at least one of the toner and the carrier in the toner container so that a difference in forces per unit volume of the toner and the carrier due to gravity becomes small.

A developing-agent supplying device according to another aspect of the present invention is for supplying developing agent that contains toner and carrier contained in a developing-agent container to a developing unit that develops an electrostatic latent image formed on a latent image carrier to form a toner image. The developing-agent supplying device includes an external-force applying unit that applies an external force to at least one of the toner and the carrier in the developing-agent container so that a difference in forces per unit volume of the toner and the carrier due to gravity becomes small.

A developing-agent container according to still another aspect of the present invention is for containing developing agent to be supplied to a developing unit, the developing agent containing toner and carrier. At least one of the toner and the carrier has a plurality of bumps on a particle surface thereof.

A developing-agent supplying device according to still another aspect of the present invention includes the developing-agent container according to the present invention. The developing-agent supplying device supplies developing agent containing toner and carrier contained in the developing-agent container to a developing unit that develops an electrostatic latent image formed on a latent image carrier to form a toner image.

An image forming apparatus according to still another aspect of the present invention includes a latent image carrier on which an electrostatic latent image is formed; a developing unit that develops the electrostatic latent image formed on the latent image carrier to form a toner image; and the developing-agent supplying device according to the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained in detail below with reference to the accompanying drawings.

A tandem-type laser color printer (hereinafter, "printer") that has a plurality of photosensitive members arranged in tandem is presented as an image forming apparatus according to a first embodiment of the present invention. The structure of the printer is described below.

Figure 1:
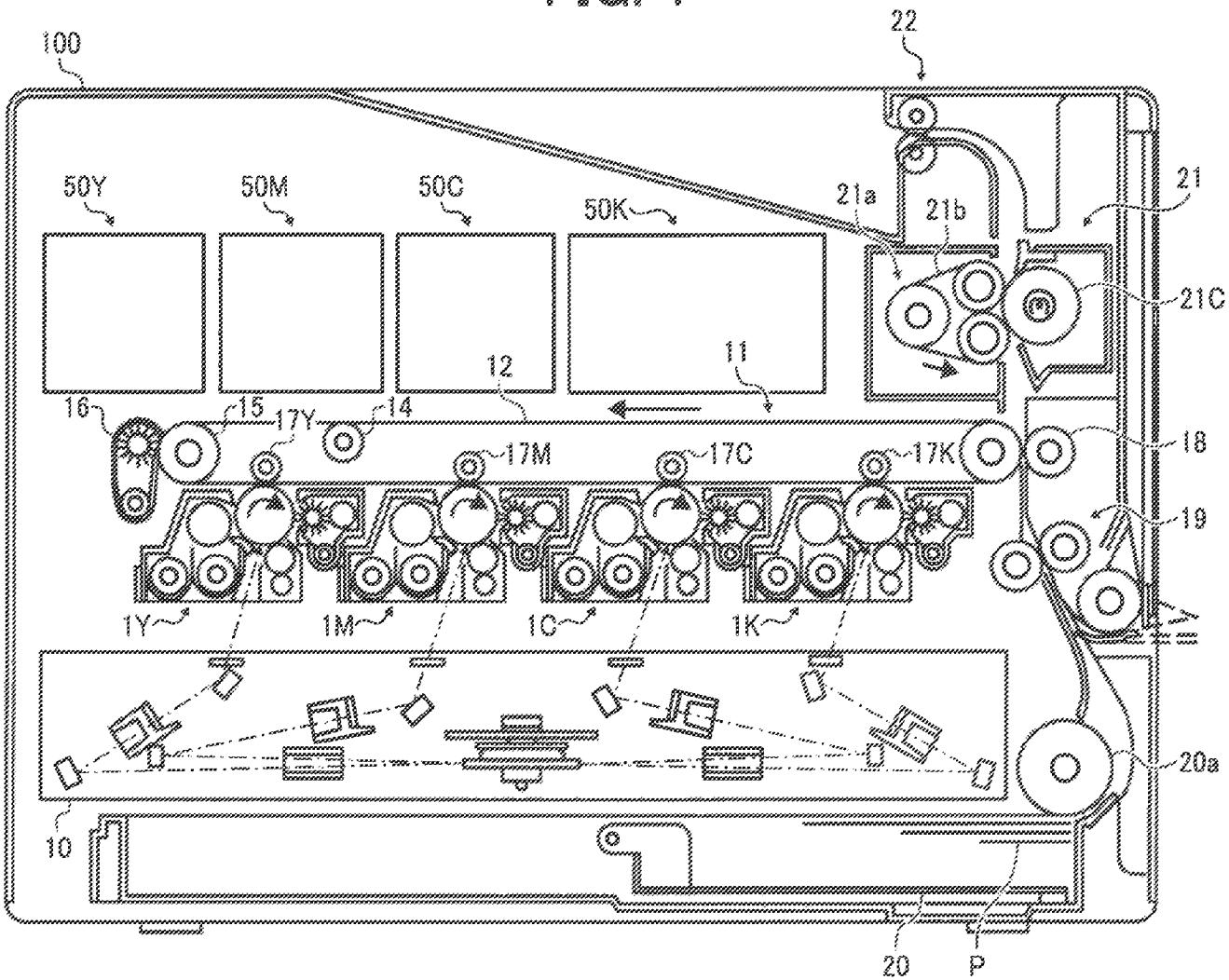
FIG. 1 is a schematic diagram illustrating a basic configuration of a printer according to a first embodiment of the present invention.

FIG. 1 is a basic configuration of a printer 100 according to the first embodiment. The printer 100 includes four sets of processing units 1Y, 1M, 1C, and 1K that form yellow (Y), magenta (M), cyan (C), and black (K) images, respectively. Hereinafter, a symbol Y, M, C, or K denoted after a number represents that the corresponding member is for yellow, magenta, cyan, or black. Apart from the processing units 1Y, 1M, 1C, and 1K, the printer 100 also includes an optical writing unit 10, an intermediate transfer unit 11, a secondary transfer bias roller 18, a pair of registration rollers 19, a paper feeding cassette 20, a belt-type fixing unit 21, etc.

The optical writing unit 10 includes a light source, polygon mirrors, an f-θ lens, reflective mirrors, etc. and irradiates a laser beam on the surface of a photosensitive member 2 based on image information. The photosensitive member 2 is described in detail later.

Figure 2:
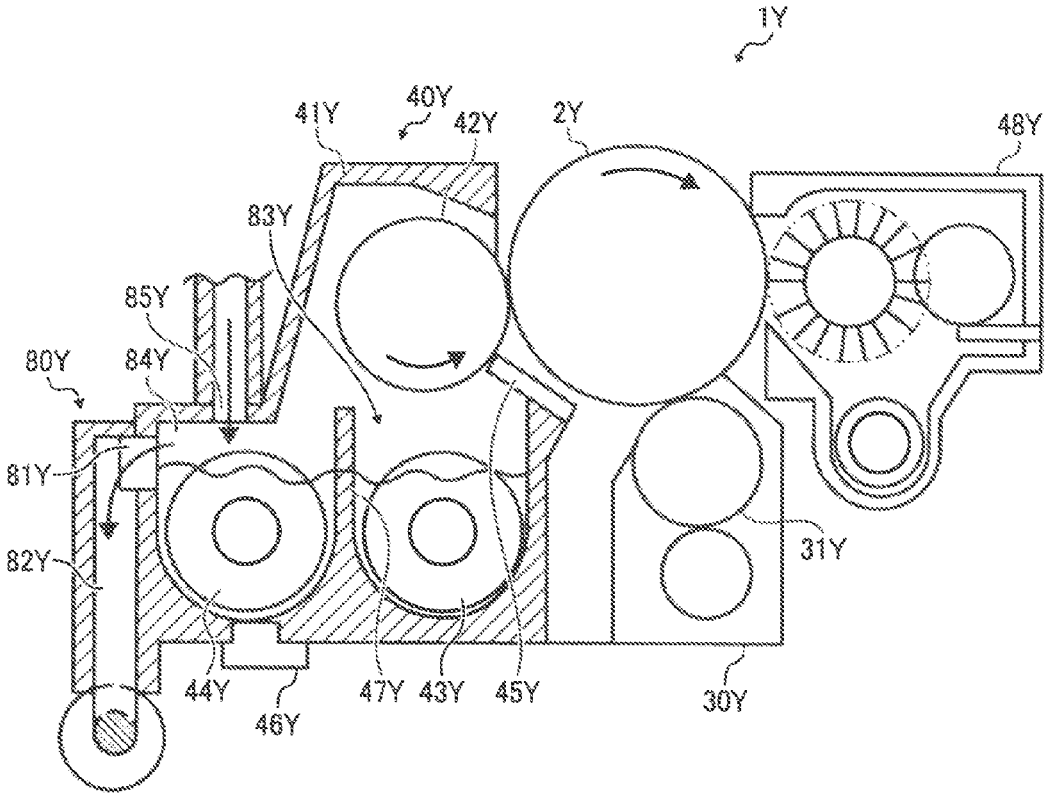
FIG. 2 is an enlarged view of a processing unit of the printer for processing the yellow color.

FIG. 2 is an enlarged view of the processing unit 1Y for processing the yellow color. The other processing units 1M, 1C, and 1K have similar configuration, and the descriptions thereof are omitted to avoid redundant explanation. The processing unit 1Y includes a drum-shaped photosensitive member 2Y, a charging unit 30Y, a developing unit 40Y, a drum-cleaning unit 48Y, a not shown discharging unit, etc.

The charging unit 30Y includes a charging roller 31Y that is applied with alternating voltage. The charging roller 31Y rubs against the photosensitive member 2Y to uniformly charge the surface of the photosensitive member 2Y in the dark. A laser beam, modulated and deflected by the optical writing unit 10, scans and irradiates the surface of the charged photosensitive member 2Y. As a result, an electrostatic latent image is formed on the surface of the photosensitive member 2Y. The developing unit 40Y develops the electrostatic latent image to form a Y toner image.

The developing unit 40Y includes a developing roller 42Y that is housed in a case 41Y. The developing roller 42Y is arranged such that a part of the surface thereof is exposed from an opening in the case 41Y. The developing unit 40Y also includes a first conveying screw 43Y, a second conveying screw 44Y, a doctor blade 45Y, a toner concentration sensor (hereinafter, "T sensor") 46Y, etc housed in the case 41Y.

The case 41Y is filled with not a shown two-component developing agent that includes a magnetic carrier and a negatively charged Y toner. The first conveying screw 43Y and the second conveying screw 44Y stir and convey the two-component developing agent so as to friction-charge the two-component developing agent. The charged two-component developing agent is carried on the surface of the developing roller 42Y. The doctor blade 45Y controls the thickness of the developing agent before the developing agent is conveyed to a developing area facing the photosensitive member 2Y, where the Y toner adheres to an electrostatic latent image on the photosensitive member 2Y. As a result, the Y toner image is formed on the photosensitive member 2Y. After the Y toner is used up for development, the two-component developing agent is returned into the case 41Y by the rotation of the developing roller 42Y.

A partition 47Y is provided between the first conveying screw 43Y and the second conveying screw 44Y. The partition 47Y divides the case 41Y into a first compartment 83Y including the developing roller 42Y and the first conveying screw 43Y, and a second compartment 84Y including the second conveying screw 44Y. The first conveying screw 43Y is rotated by a not shown driving unit to convey the two-component developing agent in the first compartment 83Y to the developing roller 42Y. The two-component developing agent conveyed to the corner of the first compartment 83Y by the first conveying screw 43Y enters into the second compartment 84Y through a not shown opening in the partition 47Y. The second conveying screw 44Y is rotated by a not shown driving unit to convey the two-component developing agent, coming form the first compartment 83Y, in a direction opposite to that of the first conveying screw 43Y. The two-component developing agent conveyed to the corner of the second compartment 84Y by the second conveying screw 44Y returns to the first compartment 83Y through another not shown opening in the partition 47Y.

A drainage opening 81Y for draining the developing agent from the second compartment 84Y is provided in the wall of the second compartment opposite to the partition 47Y. The developing agent drained from the drainage opening 81Y drips into a developing-agent collecting hopper 82Y of a developing-agent collecting unit 80Y, and is conveyed toward a not shown drained developing agent cartridge.

The T sensor 46Y, which is a permeability sensor, is situated near the center of the bottom wall of the second compartment 84Y and outputs a voltage according to the permeability of the two-component developing agent passing over the T sensor 46Y. The permeability and toner concentration of the two-component developing agent are substantially correlated. Therefore, the voltage output from the T sensor 46Y is in accordance with the concentration of the Y toner. A value of the voltage is transmitted to a not shown control unit. The control unit includes a random access memory (RAM) that stores a Vtref, which is a reference voltage, for Y. The reference voltage is the optimal voltage to be output from the T sensor 46Y. The RAM also stores the Vtref data for M, C, and K. The Vtref for Y is used to control the operation of a not shown Y developing-agent supplying device. Specifically, the control unit controls the Y developing-agent supplying device to supply an appropriate amount of Y developing agent into the second compartment 84Y, so that the voltage output from the T sensor 46Y approaches the Vtref for Y. As a result, the concentration of the Y toner of the two-component developing agent in the developing unit 40Y is maintained within a predetermined range. The toner supply is controller in the same manner in the developing units of the other processing units.

The Y toner image formed on the photosensitive member 2Y is transferred onto a not shown intermediate transfer belt. After the transfer, the drum-cleaning unit 48Y cleans off the residual toner on the surface of the photosensitive member 2Y, and a discharging lamp discharges the photosensitive member 2Y. Then the charging unit 30Y uniformly charges the photosensitive member 2Y to form a next image. The other processing units perform the same process.

As shown in FIG. 1, the intermediate transfer unit 11 includes an intermediate transfer belt 12, a driving roller 13, stretching rollers 14 and 15, a belt-cleaning unit 16, and four intermediate transfer bias rollers 17Y, 17M, 17C, and 17K. The intermediate transfer belt 12 is tensely stretched by the driving roller 13, the stretching rollers 14 and 15, and is revolved endlessly in a counter-clockwise direction as shown in FIG. 1 by the driving roller 13 that is rotated by a not shown driving system. Intermediate transfer bias is applied to the intermediate transfer bias rollers 17Y, 17M, 17C, and 17K from a not shown power source. Consequently, the intermediate transfer bias rollers 17Y, 17M, 17C, and 17K push the intermediate transfer belt 12 towards the photosensitive members 2Y, 2M, 2C, and 2K. As a result, a nip is formed between each of the intermediate transfer bias rollers and the photosensitive members. In each of the nips, an electric field is formed due to the intermediate transfer bias. The Y toner image formed on the photosensitive member 2Y is transferred onto the intermediate transfer belt 12 due to the electric field and the pressure of the nip. The M, C, and K toner images formed on the photosensitive members 2M, 2C, and 2K are sequentially superimposed on the Y toner image. As a result, a four-color toner image is formed on the intermediate transfer belt 12. The four-color toner is then transferred onto a transfer paper P, which is a recording material. The belt-cleaning unit 16 cleans off the residual toner from the surface of the intermediate transfer belt 12 after the transfer.

The paper feeding cassette 20, which stores the transfer paper P in a stack, is located below the optical writing unit 10. A paper feeding roller 20*a* is pushed against the top transfer P. When the paper feeding roller 20*a* rotates at a predetermined timing, the top transfer paper P is led into a paper conveying path.

In the intermediate transfer unit 11, the driving roller 13 contacts the secondary transfer bias roller 18, with the intermediate transfer belt 12 interposed between the two rollers, forming a nip. Secondary transfer bias is applied to the secondary transfer bias roller 18 from a not shown power source. The transfer paper P fed into the paper conveying path is sandwiched between the pair of registration rollers 19. As the intermediate transfer belt 12 rotates, the four-color toner image formed on the intermediate transfer belt 12 enters the nip. The pair of registration rollers 19 sends out the transfer paper P at a timing such that the transfer paper P comes into contact with the four-color toner image at the nip. The four-color toner image is then transferred to the transfer paper P at the nip due to the secondary transfer bias and the pressure of the nip, forming a full-color image on the transfer paper. The transfer paper P with the full-color image is conveyed to the fixing unit 21.

The fixing unit 21 includes a belt unit 21*b* in which a fixing belt 21*a* is stretched over three rollers and is endlessly revolved, and a heating roller 21*c* having a heat source inside. The transfer paper P is conveyed in between the belt unit 21*b* and the heating roller 21*c*, so that the full-color image is fixed on the surface of the transfer paper P. A pair of paper discharge rollers 22 leads the transfer paper P outside the printer.

As described above, the printer includes a visible image forming unit that forms a visible image onto a recording material by using the processing units 1Y, 1M, 1C, 1K, the intermediate transfer unit 11, and so forth.

Developing-agent containers 50Y, 50M, 50C, and 50K containing the toner of Y, M, C, and K, respectively, are described below.

Figure 3:
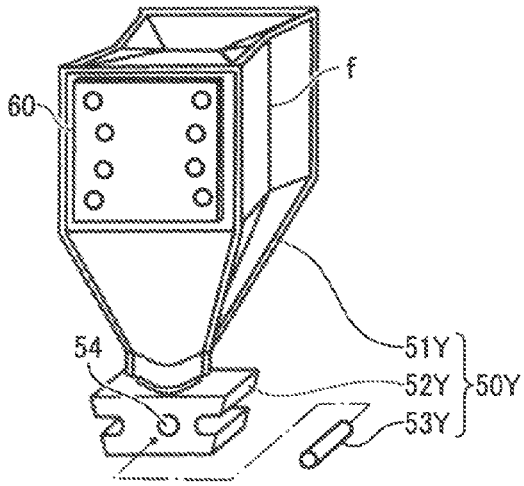
FIG. 3 is a perspective view of a developing-agent container of the printer for a Y toner.

FIG. 3 is a perspective view of the developing-agent container 50Y. The developing-agent container 50Y includes a bag portion 51Y that is bag-shaped and made of soft material, a base portion 52Y that is a cap member, and a rod 53Y. The bag portion 51Y is square-shaped, made of a single sheet or layers of sheets, and has a thickness of 50 μm to 210 μm. The bag portion 51Y is deformable and contains the Y developing agent that includes the Y toner and the carrier. The sheet can be made of a resin material including polyester, polyethylene, and nylon, or it can be made of paper. In the present embodiment, the bag portion 51Y has two layers, a polyethylene sheet on the inside, that welds to the base portion 52Y and a nylon sheet on the outside. The bag portion 51Y also has reinforcing layers 60 made of a material including polyethylene terephthalate and aluminum, provided externally on two opposing sides (in FIG. 3, on the surface in the foreground and its opposite surface in the background).

Fold lines f are provided on the bag portion 51Y on the sides where the reinforcing layer 60 are not provided. When the bag portion 51Y shrinks, the surfaces provided with the reinforcing layers 60 are maintained in a flat state without forming any creases due to the strength of the reinforcing layers 60. Therefore, the fold lines f do not deform and remain straight. As a result, the bag portion 51Y gets neatly folded along the fold lines f as the bag portion 51Y shrinks due to depleting Y developing agent in the bag portion 51Y.

There are eight holes on each of the reinforcing layers 60. A user can hook his/her fingers into these holes, making it convenient to hold the developing-agent container 50Y to shake it or to fit it into a container holder. These holes also function as reference marks that indicate to the user the appropriate positions at which to place the fingers. This prevents the user from holding the bag portion 51Y in such a way that the fold lines f deform, so that the bag portion 51Y shrinks in a fixed shape.

The upper half of the bag portion 51Y is a substantially rectangular solid shape when inflated, and the bottom half is an inverse quadrangular pyramid (in a taper form), forming a hopper that pours the toner downwards to the base portion 52Y. The base portion 52Y is made of a rigid material including resin, and is welded to the tip of the hopper. The developing-agent container 50Y is positioned such that the base portion 52Y is at the bottom, and the bag portion 51Y is connected to the base portion 52Y. A through hole 54Y is formed in the base portion 52Y. When the rod 53Y is inserted into the through hole 54Y, the not shown Y developing agent remains sealed in the developing-agent container 50Y. The other developing-agent containers 50M, 50C, and 50K have a configuration that is similar to that of the developing-agent container 50Y, and hence the descriptions thereof are omitted.

A configuration and operation of a developing-agent supplying device 200 that conveys the developing agent for each color to a developing unit 40 is described below.

Figure 4:
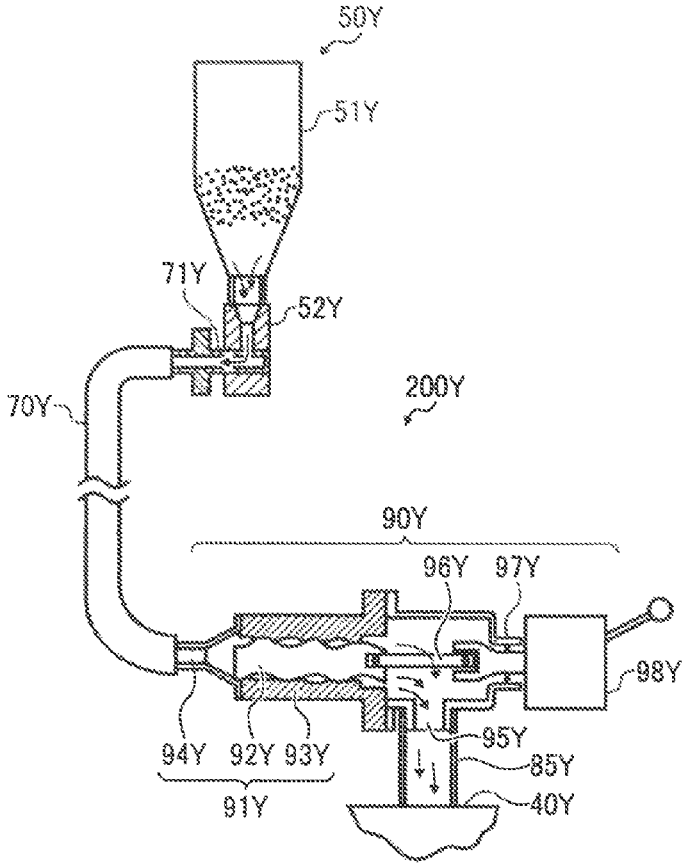
FIG. 4 is a schematic diagram of a developing-agent supplying device and a part of a developing unit of the printer for the Y toner.

FIG. 4 is a drawing of the developing-agent supplying device 200 and a part of the developing unit 40 for the Y toner. The developing-agent supplying device 200 includes a conveying tube 70Y, a nozzle 71Y that forms a toner conveying path, and a suction pump 90Y. The not shown container holder holds the developing-agent container 50Y. The developing-agent container 50Y is fitted into the container holder such that the base portion 52Y is positioned at the bottom. The developing-agent container 50Y is replaced with a new developing-agent container when the toner is substantially finished. The nozzle 71Y is inserted into the through hole 54Y of the base portion 52Y of the new developing-agent container 50Y, pushing out the rod 53Y from the through hole 54Y. As a result, the nozzle 71Y is connected to the base portion 52Y and the toner conveying path is formed. The Y toner ejected from the developing-agent container 50Y is conveyed to the developing unit 40Y through the toner conveying path.

The other end of the nozzle 71Y is connected to the conveying tube 70Y. The conveying tube 70Y is made of a flexible material such as rubber or resin that has excellent toner resistance, and has an internal diameter $\phi$ of 4 mm to 10 mm. The other end of the conveying tube 70Y is connected to a pump unit 91Y included in the suction pump 90Y. The suction pump 90Y is a so-called uniaxial eccentric screw pump (commonly known as a mono pump), which includes the pump unit 91Y, a discharge portion 95Y in connection with the pump unit 91Y, an axial member 96Y, a universal joint 97Y, and a suction motor 98Y.

The pump unit 91Y includes a rotor 92Y in a shape of an eccentric double-thread screw, made of metal or highly rigid resin, a stator 93Y that is hollow inside in the shape of a double-thread screw and made of rubber, and a suction port 94Y. When the suction motor 98Y rotates, the rotational drive is transmitted to the rotor 92Y via the universal joint 97Y and the axial member 96Y. As a result, the rotor 92Y rotates inside the stator 93Y, and negative pressure is generated at the suction port 94Y. Due to the negative pressure, the Y toner in the bag portion 51Y is sucked into the suction pump 90Y through the base portion 52Y, the nozzle 71Y, and the conveying tube 70Y, and is then discharged into the discharge portion 95Y through the stator 93Y. The discharge portion 95Y is connected to the second compartment 84Y of the developing unit 40Y, and the Y toner is supplied to the second compartment 84Y to be mixed with the not shown two-component developing agent.

The developing-agent container 50Y does not require any movable members, such as an auger, to convey the Y toner, because the suction pump 90Y conveys the Y toner. Accordingly, the developing-agent container 50Y can be simple in structure and lightweight. In addition, the suction pump 90Y shrinks the bag portion 51Y, reducing the volume of the developing-agent container 50Y. As a result, transportation costs can be reduced when returning the used developing-agent containers 50Y to the manufacturer for recycling purposes. Also, the conveying tube 70Y does not require any screws, etc. to convey the toner, enabling the conveying tube 70Y to be bent flexibly. Moreover, the developing-agent container 50Y does not necessarily need to be located below the developing unit 40Y, because the suction pump 90Y can pump up and convey the toner, regardless of gravity. As a result, the toner conveying path can be laid out anywhere in the printer, which is advantageous in various respects.

Figure 5:
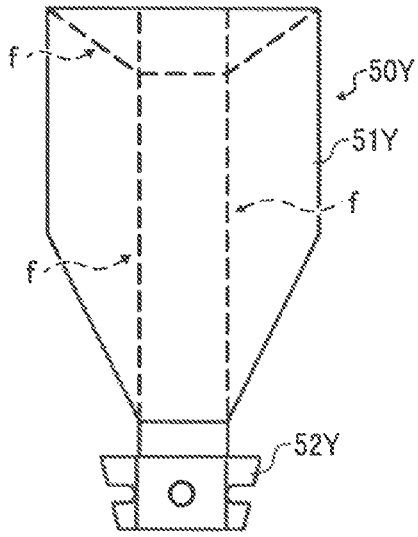
FIG. 5 is a schematic diagram of the developing-agent container in a collapsed state.

It is preferable that the fold lines f, as shown in FIG. 3, be provided on the bag portion 51Y, so that the bag portion 51Y shrinks along the fold lines f due to suction, and folds into a substantially flat shape as shown in FIG. 5. As a result, the transportation costs of the used containers can be further reduced.

Figure 6:
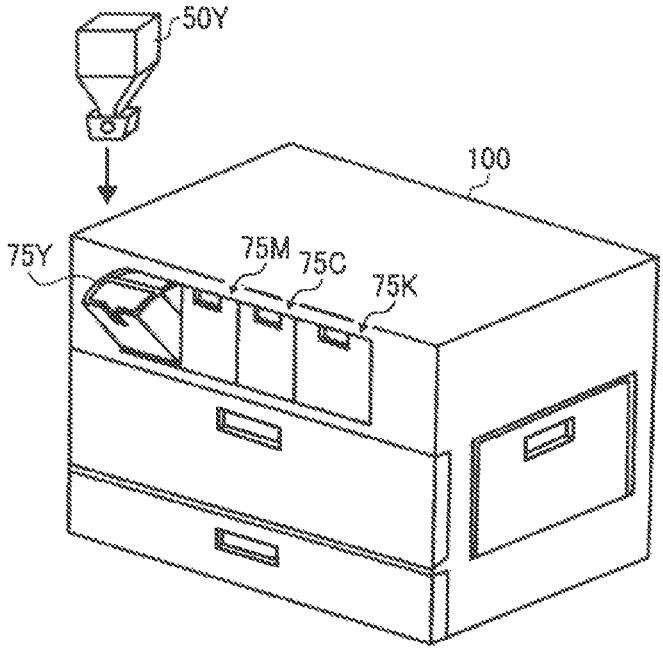
FIG. 6 is a perspective view of the printer.

FIG. 6 is a perspective view of the printer 100.

There are four container holders 75Y, 75M, 75C, and 75K, functioning as container holding devices, located on the front side of the printer 100. The container holders open and close by pivoting on a not shown rotational shaft. Each container holder constitutes a part of the developing-agent supplying device 200, and holds the developing-agent container of the corresponding color. The user unlocks a not shown lock when setting the developing-agent container 50Y into the container holder 75Y so that the container holder 75Y opens towards the front. When fitting the developing-agent container 50Y in the printer 100, the user holds the bag portion 51Y with both hands such that the base portion 52Y is at the bottom in a vertical direction, and inserts the developing-agent container 50Y into the container holder 75Y, closing the container holder 75Y once the developing-agent container 50Y is placed inside.

In the developing-agent container 50 according to the first embodiment, a premixed developing agent that includes the toner and the carrier is filled in the bag portion 51.

Figure 7A:
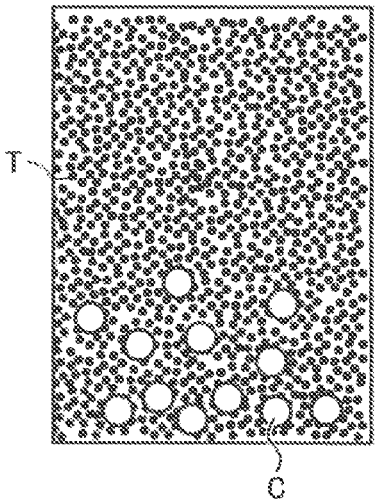
FIG. 7A is a schematic diagram of an uneven distribution of toner particles and carrier particles in the developing agent in the developing-agent container.

In the conventional developing-agent container containing the premixed developing agent, some time after the developing-agent container is shaken well to evenly distribute the toner and the carrier and fitted, the bulk of the premixed developing agent stabilizes when the toner and the carrier settle by expelling the trapped air. The high specific gravity carrier particles sink faster than the low specific gravity toner particles, accounting for greater concentration of the carrier particles at the bottom of the developing-agent container, as shown in FIG. 7A. If a developing-agent container with unevenly distributed developing agent is fitted into the image forming apparatus, a developing agent containing a higher concentration of the carrier is conveyed either initially when the developing-agent container 50 is newly fitted or towards the end when the developing agent in the developing-agent container 50 is finishing, leading to unsteady control over toner density and resulting in a faulty image. Specifically, if the developing-agent container 50 is fitted such that the base portion 52, which is the opening of the bag portion 51, is oriented downwards, the carrier particles sink to the base portion 52, and initially, primarily the carrier gets conveyed to the developing unit 40, leading to unsteady control over toner density and resulting in a faulty image. On the other hand, if the developing-agent container 50 is fitted such that the base portion 52 is oriented upwards, the carrier is not conveyed to the developing unit 40 until the end as the carrier particles have sunk to the bottom, again leading to a faulty image due to failure to replenish the carrier in the developing unit 40. Also, unsteady control over toner density will result as in the case when the developing-agent container 50 is fitted with the base portion 52 oriented downwards because the developing agent conveyed to the developing unit 40 has too much carrier and too little toner.

The image forming apparatus disclosed in Japanese Patent Application Laid-open No. 2004-29306 uses a low specific gravity carrier to prevent the carrier from sinking to the bottom of the container. However, this would impose restrictions on the raw material that can be used for making the carrier and the toner, thus increasing the cost. Further, there is a limit to which the difference in the specific gravities of the carrier and the toner can be reduced, adversely affecting the effect of preventing the carrier from sinking to the bottom.

Figure 7B:
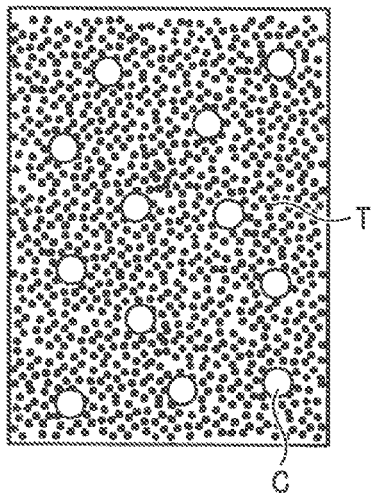
FIG. 7B is a schematic diagram of an even distribution of the toner particles and the carrier particles in the developing agent in the developing-agent container.

On the other hand, the developing-agent container 50 used in the printer 100 according to the first embodiment is fitted in the printer 100 with the developing agent settled with tightly packed and evenly distributed toner and carrier. FIG. 7B is a drawing of a state of distribution of the toner particles and the carrier particles of the developing agent in the developing-agent container 50 according to the first embodiment. As shown in FIG. 7B, the developing-agent container 50 contains the developing agent with the toner and the carrier evenly distributed, accounting for a steady control of toner concentration in the developing unit 40, and resulting in satisfactory image formation.

The salient feature of a manufacturing method of the developing-agent container 50 containing the premixed developing agent used in the printer 100 according to the first embodiment is described below.

Figure 8A:
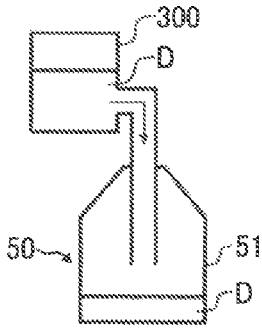
FIG. 8A is a schematic diagram of a filling process in which a premixed developing agent is filled in a bag portion of the developing-agent container.
Figure 8B:
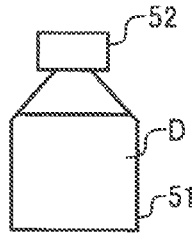
FIG. 8B is a schematic diagram of a base portion fitted over the bag portion.
Figure 8C:
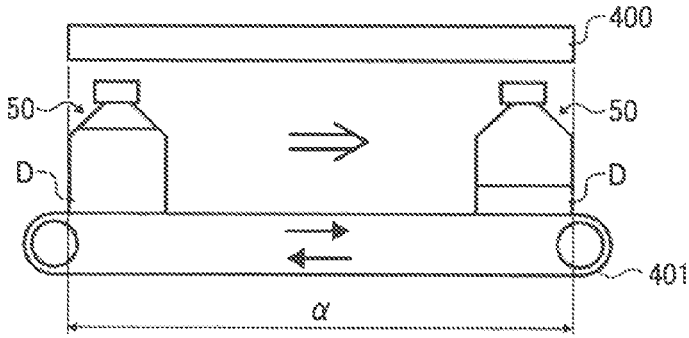
FIG. 8C is a schematic diagram of a process where the developing-agent container is made to traverse a magnetic field zone.

FIGS. 8A to 8C are drawings of a manufacturing process of the developing-agent container 50, including a filling process of filling the premixed developing agent in the developing-agent container 50 and subsequent processes.

FIG. 8A is a drawing of the filling process in which a premixed developing agent D is filled in the bag portion 51 of the developing-agent container 50. The premixed developing agent D, which includes measured amounts of toner and carrier, is placed in a mixer 300 serving as a developing agent agitating device, and is agitated for 60 seconds before being filled in the bag portion 51. By agitating the premixed developing agent D in the mixer 300 for 60 seconds, evenly distributed toner and carrier can be obtained. Agitation also introduces plenty of air in the developing agent.

Next, as shown in FIG. 8B, the base portion 52 that is the cap member is fitted over the bag portion 51 filled with the premixed developing agent D by the filling process shown in FIG. 8A. Next, as shown in FIG. 8C, the developing-agent container 50, with the base portion 52 fitted over the bag portion 51, is mounted on a belt conveyer 401 and made to traverse a magnetic field zone $\alpha$ of a magnet 400 disposed above the belt conveyer 401 for a predetermined length of time. The predetermined length of time is the time required for the bulk of the premixed developing agent D to settle by expelling the trapped air. The developing-agent container 50 according to the first embodiment mounted on the belt conveyer 401 is made to traverse the magnetic field zone $\alpha$ for ten minutes.

The premixed developing agent D being filled into the developing-agent container 50 has plenty of air incorporated in it. The bulk of the premixed developing agent D in the developing-agent container 50 settles with the toner particles and the carrier particles sinking and packing tightly by expelling the trapped air. If during the settling process, the developing-agent container 50 is left outside the magnetic field zone $\alpha$, the high specific gravity carrier will sink to the bottom of the developing-agent container 50 faster than the low specific gravity toner.

However, as the developing-agent container 50 is mounted on the belt conveyer 401 and made to traverse the magnetic field zone $\alpha$, as shown in FIG. 8C, due to the attraction of the carrier particles to the magnet 400, an upward force comes into play. In the magnetic field zone $\alpha$, while the toner particles in the developing-agent container 50 are subjected only to gravitational force, which acts in non-contact fashion, the carrier particles are subjected to gravitational force that acts downwards and a magnetic force that acts upwards. The downward force per unit volume of the carrier reduces due to the upward magnetic force, hence reducing the difference in the downward forces per unit volume of the carrier and the toner.

It is preferable that the magnetic field in the magnetic field zone $\alpha$ be such that the apparent specific gravity of the carrier in the developing-agent container 50 should become equivalent to that of the toner. In other words, the following conditional expression (1) given below should be satisfied.

$$\text{(Gravitational force per unit volume of carrier)}-\text{(Magnitude of magnetic force per unit volume of carrier)}\approx\text{(Gravitational force per unit volume of toner)} \quad (1)$$

Thus, the carrier can be prevented from sinking to the bottom by creating a magnetic field in the magnetic field zone $\alpha$ that satisfies the expression (1). Hence, a premixed developing agent with evenly distributed toner particles and carrier particles can be obtained.

The difference in gravitational forces per unit volume of the carrier and the toner in non-contact fashion due to the difference in the specific gravities of the carrier and toner is reduced in the magnetic field zone $\alpha$, thus preventing the high specific gravity carrier particles from sinking faster than the low specific gravity toner.

In the first embodiment, after filling the bag portion 51 of the developing-agent container 50 with the premixed developing agent, the bulk of the premixed developing agent is allowed to settle in the magnetic field zone $\alpha$, thus preventing the carrier particles from sinking faster than the toner particles and preventing degradation of even distribution of the carrier particles and the toner particles. Consequently, a developing agent with tightly packed and evenly distributed toner and carrier, as shown in FIG. 7B, and with its bulk stabilized can be obtained.

Figure 9:
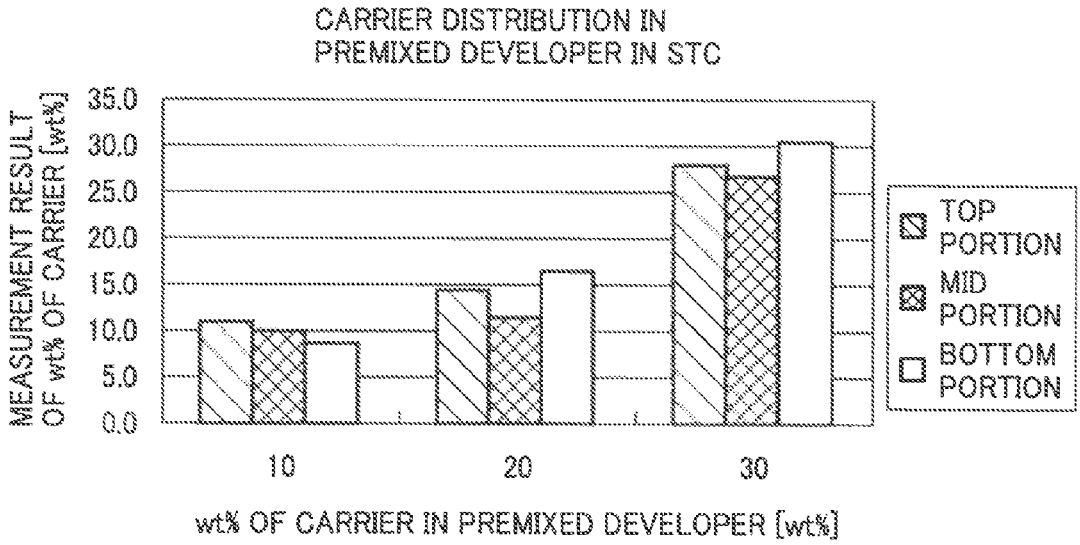
FIG. 9 is a graph of measured results of carrier distribution.

FIG. 9 is a drawing of measured results of the carrier distribution at the top portion, mid portion, and the bottom portion in the premixed developing agent-filled developing-agent container 50 that has been made to traverse the magnetic field zone α for ten minutes at different weight percents of the carrier. Thus, even if the weight percent of the carrier in the premixed developing agent is varied, the weight percent of the carrier in the top portion, mid portion and the bottom portion is equitable when the developing agent settles with tightly packed toner particles and carrier particles.

Once the bulk of the developing agent settles with the toner particles and the carrier particles packed tightly and no space between them, relative movement of the toner particles and the carrier particles is virtually impossible unless air is incorporated again by vigorous shaking. Thus, the developing agent with evenly distributed toner and carrier obtained at the manufacturing level is virtually devoid of air during normal transportation or while the developing-agent container 50 is being fitted in the printer 100. Therefore, if the developing-agent container 50 is fitted in the printer 100 without first shaking it, even distribution of the toner and the carrier in the developing agent is preserved. Further, as there is no agitating unit provided in the developing-agent container 50, no air is introduced in the developing agent even after the developing-agent container 50 is fitted so that it can continue to supply the developing agent with evenly distributed toner and carrier to the developing unit 40.

As the toner and the carrier in the premixed developing agent in the developing-agent container 50 are evenly distributed, the developing agent supplied from the developing-agent container 50 to the developing unit 40 will have a steady toner-to-carrier ratio. Consequently, the concentration of the toner in the developing unit 40 is stabilized and the depleted carrier in the developing unit 40 is also replaced. As a result, good image quality can be sustained.

Figure 10:
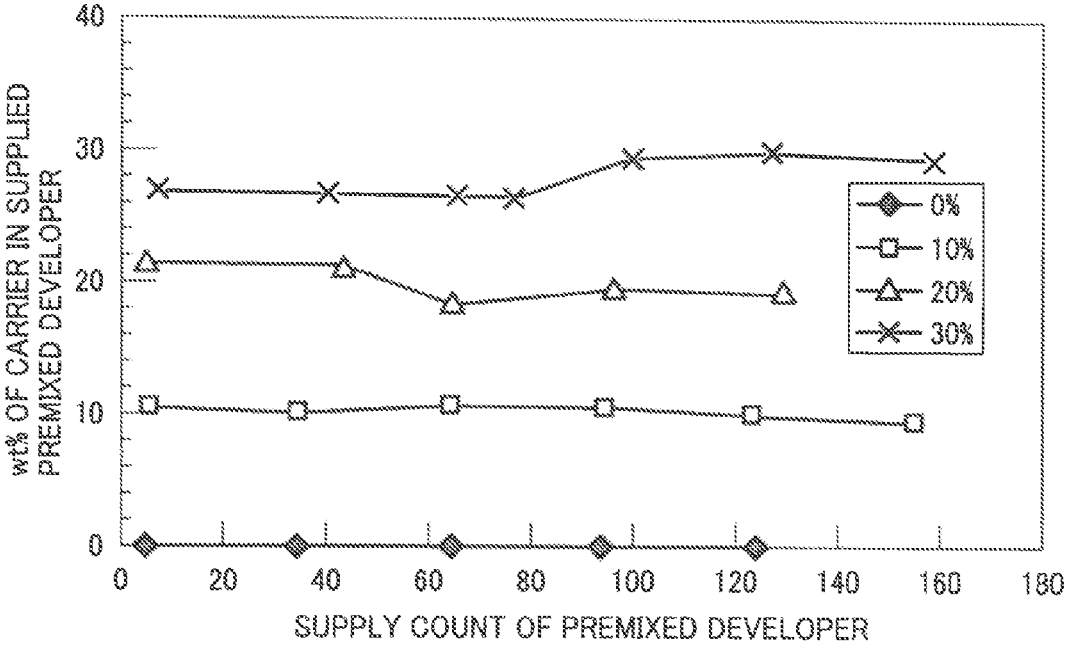
FIG. 10 is a graph showing a relation between supply count of the premixed developing agent and a weight percent (wt %) of the carrier in the supplied premixed developing agent.

FIG. 10 is a graph showing a relation between the number of times the premixed developing agent is supplied and the weight percent (wt %) of the carrier in the supplied premixed developing agent at different weight percents of the carrier in the premixed developing agent. Thus, by fitting the developing-agent container 50 containing a premixed developing agent with evenly distributed carrier and toner, supply of premixed toner with a steady weight percent of carrier can be sustained regardless of the weight percent of the carrier in the premixed toner.

As the premixed developing agent continues to be supplied to the developing unit 40, the developing-agent container 50 according to the first embodiment shrinks gradually with hardly any churning action. Thus, as shown in FIG. 10, premixed developing agent with a constant weight percent (wt %) of the carrier is supplied.

The magnet 400 can be a permanent magnet or an electromagnet. In the first embodiment, the developing-agent container 50 is made to traverse the magnetic field zone α for a predetermined length of time (10 minutes) by the belt conveyer 401. However, instead of traversing the magnetic field zone α, the developing-agent container 50 can simply be made to rest in the magnetic field zone α for a predetermined length of time after which it may be removed from there.

In the first embodiment, a force acts on the carrier particles in the developing-agent container 50 in the magnetic field zone α formed by the magnet 400, pulling the carrier particles upwards. In a first modification, an electric field can be used to produce the force for pulling the carrier particles upwards.

Figure 11A:
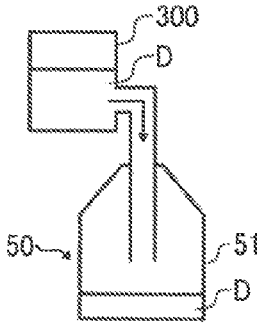
FIG. 11A is a schematic diagram of the filling process according to a first variation in which the premixed developing agent is filled in the bag portion of the developing-agent container.
Figure 11B:
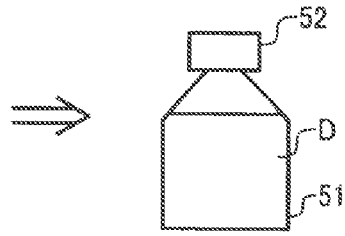
FIG. 11B is a schematic diagram of a base portion fitted over the bag portion according to the first variation.
Figure 11C:
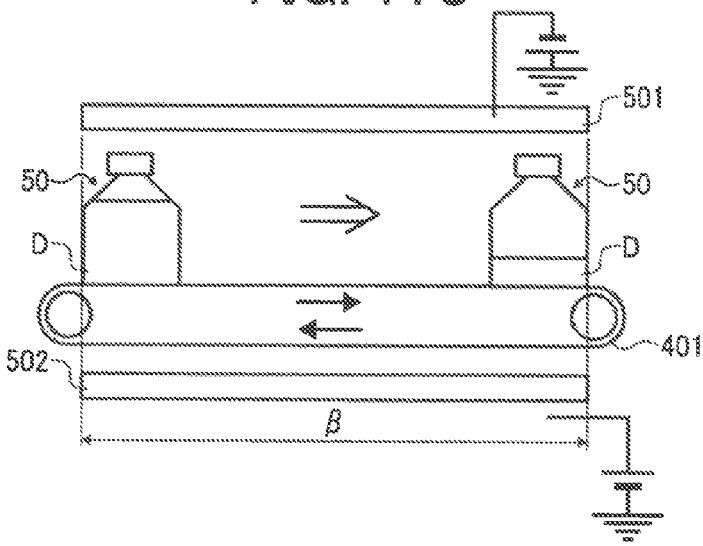
FIG. 11C is a schematic of a process according to the first variation where the developing-agent container is made to traverse an electric field zone.

FIGS. 11A to 11C are drawings of a manufacturing process of the developing-agent container 50 according to the first modification, including the filling process of filling the premixed developing agent in the developing-agent container 50 and subsequent processes.

As in FIG. 8A, in FIG. 11A, the premixed developing agent is agitated in the mixer 300 and filled in the bag portion 51 of the developing-agent container 50. When filled, the premixed developing agent has evenly distributed toner and carrier with plenty of air incorporated in it.

Next, as shown in FIG. 11B, the base portion 52 that is a cap member is fitted over the bag portion 51 containing the premixed developing agent D filled in the filling step shown in FIG. 11. Next, as shown in FIG. 11C, the developing-agent container 50, with the base portion 52 fitted over the bag portion 51, is mounted on the belt conveyer 401, and made to traverse an electric field zone β formed by an upper electrode plate 501 and a lower electrode plate 502 disposed above and below the belt conveyer 401, respectively, for a predetermined length of time. A negative bias is applied to the upper electrode plate 501 and a positive bias is applied to the lower electrode plate 502, forming an electric field therebetween. When the premixed developing agent D is agitated in the mixer 300, the toner assumes a negative polarity whereas the carrier assumes a charge of positive polarity due to frictional electrification.

The predetermined length of time is the time required for the bulk of the premixed developing agent D to settle by expelling the trapped air. The developing-agent container 50 according to the first modification mounted on the belt conveyer 401 is made to traverse the electric field zone β for ten minutes.

When the developing-agent container 50 is traversing the electric field zone β, the carrier particles that carry a positive polarity are repelled by the lower electrode plate 502 and attracted to the upper electrode plate 501. Thus, an upward force comes into play in non-contact fashion on the carrier particles. On the other hand, the toner particles that carry a negative polarity are repelled by the upper electrode plate 501 and attracted to the lower electrode plate 502. Thus, a downward force comes into play in non-contact fashion on the toner particles.

As the specific gravity of the carrier is greater than that of the toner, the downward force per unit volume of the carrier due to gravity is greater than that of the toner. In the electric field zone β, the electric field applies the upward force on the carrier, which is being pulled downwards due to gravity. On the other hand, the electric field applies a downward force on the toner, which is being pulled downward due to gravitational force. In effect, the net downward force per unit volume of the carrier reduces, and the net upward force per unit volume of the toner increases, reducing the difference in the net downward forces per unit volume of the carrier and the toner.

Additionally, in the case of the toner, a Coulomb's force acts in the sinking direction of the toner speeding up the sinking of the toner and reducing the time required for attaining a stabilized state. As a result, the filling process takes less time, reducing cost.

It is preferable that the electric field in the electric field zone β be such that the apparent specific gravity of the carrier in the developing-agent container 50 should become equivalent to that of the toner. In other words, the following conditional expression (2) given below should be satisfied.

(Gravitational force per unit volume of carrier)−(Magnitude of force per unit volume of carrier due to electric field)≈(Gravitational force per unit volume of toner)+(Magnitude of force per unit volume of toner due to electric field) (2)

Thus, the carrier can be prevented from sinking to the bottom by creating an electric field in the electric field zone β that satisfies the expression (2). Hence, a premixed developing agent with evenly distributed toner particles and carrier particles can be obtained.

The difference in gravitational forces per unit volume of the carrier and the toner in non-contact fashion due to the difference in the specific gravities of the carrier and toner is reduced in the electric field zone β, thus preventing the high specific gravity carrier particles from sinking faster than the low specific gravity toner particles.

Thus, even distribution of the toner and the carrier in the premixed developing agent can be prevented from degrading, enabling the bulk of premixed developing agent to settle with the toner particles and the carrier particles tightly packing and expelling the trapped air while sinking, while maintaining even distribution of the toner and the carrier. When the developing-agent container 50 containing such a premixed developing agent is fitted into the printer 100, the steady concentration of the premixed developing agent being supplied stabilizes the concentration of the toner in the developing unit 40 and also replaces the depleted carrier in the developing unit 40. As a result, good image quality can be sustained.

In the first embodiment, the high specific gravity carrier is prevented from sinking by applying an upward force on the carrier when the developing agent is settling by expelling the trapped air during the manufacture of the developing-agent container 50. In a second embodiment of the present invention, the carrier is prevented from sinking by modifying the shape of the carrier particle or the toner particle. The basic structures of the printer 100, the developing-agent supplying device 200, and the developing-agent container 50 according to the second embodiment are identical to those of the first embodiment. The difference between the first embodiment and the second embodiment lies in the shape of the particles of the developing agent in the developing-agent container 50. The descriptions of the second embodiment that are identical to the first embodiment are omitted here. Only aspects unique to the second embodiment are described below.

Figure 12:
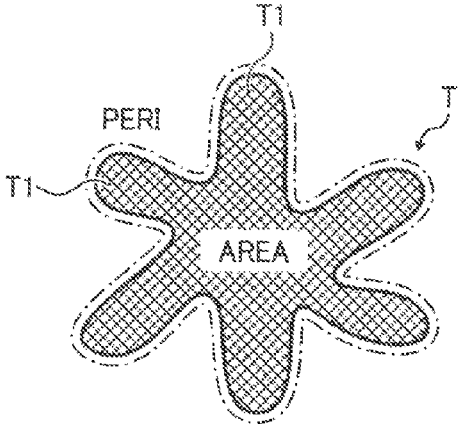
FIG. 12 is a schematic diagram of a toner particle of the toner used in the toner container according to a second embodiment of the present invention.

FIG. 12 is a drawing of a toner particle T used in the second embodiment. The toner particle T has an irregular surface with a plurality of bumps T1. The premixed developing agent including the toner particles T and the carrier particles is agitated to incorporate air so that the toner particles T and the carrier particles are evenly distributed, and filled in the developing-agent container 50. When the toner particles T and the carrier particles sink, packing tightly and expelling the trapped air from the premixed developing agent, and settling the bulk of the premixed developing agent, the high specific gravity carrier particles sink faster than the low specific gravity toner particles T. However, carrier particles get entangled in the bumps T1 of the toner particles T on their descent. Consequently, when the carrier particles gravitate downwards, they take with them the toner particles T with which they have got entangled. Hence, both the carrier particles and the toner particles sink to the bottom together. By preventing the high-specific gravity carrier particles from sinking to the bottom faster than the low-specific gravity toner particles T, the bulk of the premixed developing agent is allowed to settle while maintaining even distribution of the toner particles T and the carrier particles.

In the second embodiment, even distribution of the toner and the carrier is prevented from degrading while the premixed developing agent is settling by expelling the trapped air due to the shape of the toner. Consequently, the magnetic field zone α or the electric field zone β as in the first embodiment is rendered unnecessary. The user can fit the developing-agent container 50 in the printer 100 after shaking it vigorously so as to improve even distribution of the toner and the carrier. As no special environment is required for sustaining even distribution of the toner and the carrier when the premixed developing agent is settling, even if plenty of air is incorporated in the premixed developing agent in the developing-agent container 50 prior to being fitted in the printer 100, even distribution of the premixed developing agent does not degrade when the developing agent is settling in the printer 100.

Thus, the premixed developing agent in the developing-agent container 50 can be prevented from degrading, the bulk of the premixed developing agent settling while maintaining even distribution of the toner and the carrier. By fitting the developing-agent container 50 in the developing-agent supplying device 200, a developing agent with a steady toner-to-carrier ratio is conveyed to the developing unit 40. When the developing-agent supplying device 200 with the developing-agent container 50 according to the second embodiment is fitted in the printer 100, the steady concentration of the premixed developing agent being supplied stabilizes the concentration of the toner in the developing unit 40 and also replaces the depleted carrier in the developing unit 40. As a result, good image quality can be sustained.

Shape factor SF-2 indicates the degree of unevenness of the surface of the toner particle T. The shape factor SF-2 of the toner particle T according to the second embodiment is 110 to 180. The shape factor SF-2 is represented by Expression (3) given below and is a numerical value obtained dividing the square of the perimeter PERI of an elliptical figure formed when the spherical toner is projected onto a two-dimensional plane, by the area AREA of the figure and multiplying the division result by 100π/4.

$$SF\text{-}2=\{(PERI)^2/\mathrm{AREA}\}\times(100\pi/4) \quad (3)$$

When the value of SF-2 is 100, the toner surface is smooth, and as the value increases, the unevenness of the toner surface becomes more and more conspicuous. The shape factor is calculated by producing images of the toner by a scanning electron microscope (S-800, manufactured by Hitachi Corporation), and introducing the images into an image analyzing apparatus (Luzex3, manufactured by Nireco Ltd.) and analyzing it.

By using toner particles T having the shape factor SF-2 of 110 or greater and causing the carrier to get entangled in the bumps T1 of the toner particles T, the carrier particles can be prevented from sinking to the bottom alone. However, if the shape factor SF-2 exceeds 180, the transfer rate drops and hence is not advisable.

In the second embodiment, the developing-agent container 50 is filled with a premixed developing agent that includes toner particles having bumps T1 on its surface. However, the carrier particles can have surface bumps instead, so that the toner particles get entangled in the bumps on the surface of the carrier particle and sink with the carrier particle. Like the toner particle, it is preferable that the shape factor SF-2 of the carrier particle be 110 or greater.

If the shape factor SF-2 of the toner particles or the carrier particles is 110 or greater, better cleaning can be carried out and even distribution of the toner and the carrier can be obtained.

If the developing-agent container 50 is filled with a premixed developing agent that includes toner particles and carrier particles, both with bumps on their surface, the carrier particles get more easily entangled in the toner particles, thus more effectively preventing the carrier particles from sinking to the bottom alone.

In the first embodiment, at the manufacturing stage, plenty of air is incorporated in the developing agent that is filled in the developing-agent container 50 and the developing-agent container 50 is made to traverse the magnetic field zone α formed by the magnet 400 when the bulk of the developing agent is settling by expelling the trapped air. The upward force in the magnetic field zone α prevents the high specific gravity carrier from sinking faster than the low specific gravity toner.

In a third embodiment of the present invention, the magnet 400 is provided in the developing-agent supplying device 200, the magnet 400 causing an upward force to act on the carrier in the developing-agent container 50 fitted in the developing-agent supplying device 200.

The printer 100, the developing-agent supplying device 200, and the developing-agent container 50 according to the third embodiment are identical to those in the first embodiment, the only difference being that the magnet 400 is provided in the developing-agent supplying device 200. The descriptions of the third embodiment that are identical to the first embodiment are omitted here. Only aspects unique to the third embodiment are described below.

Figure 13:
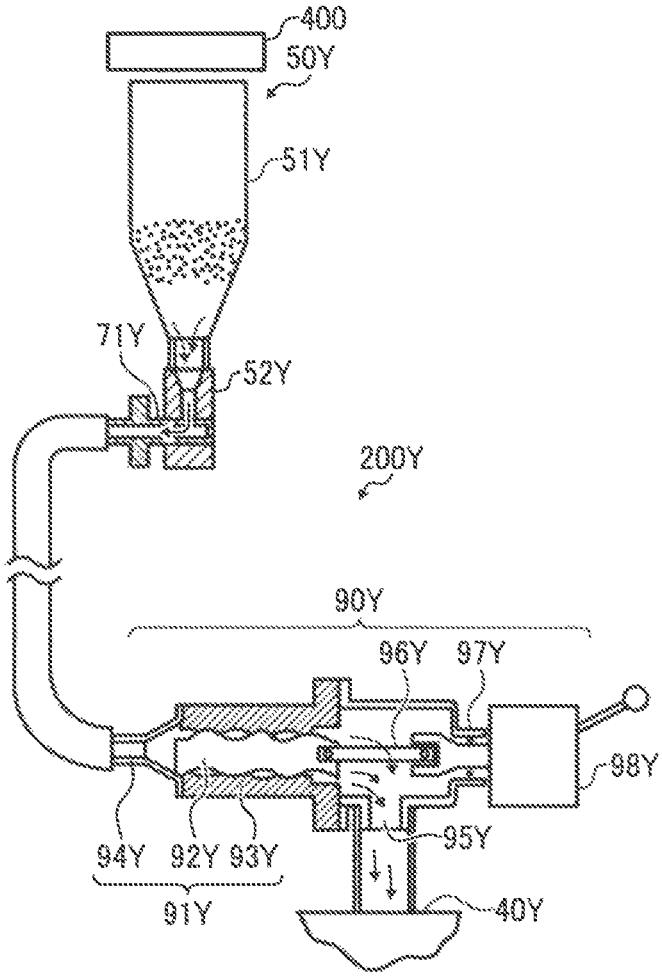
FIG. 13 is a schematic diagram of the developing-agent supplying device and a part of the developing unit for the Y toner according to a third embodiment of the present invention.

FIG. 13 is a drawing of the developing-agent supplying device 200 and a part of the developing unit 40 for the Y developing agent according to the third embodiment. The developing-agent supplying device 200 according to the third embodiment is structurally similar to the developing-agent supplying device according to the first embodiment shown in FIG. 4, except that the developing-agent supplying device 200 according to the third embodiment has the magnet 400 serving as a magnetic-field forming unit disposed above the place where the developing-agent container 50 is fitted, as shown in FIG. 13.

The developing-agent container 50 fitted in the printer 100 that includes the developing-agent supplying device 200 according to the third embodiment is filled with the premixed developing agent that includes toner and carrier, incorporated with air. The developing-agent container 50 is vigorously shaken so as to improve even distribution of the toner and the carrier in the premixed developing agent prior to be being fitted in the printer 100. When being fitted in the printer 100, the developing-agent container 50 is fitted below the magnet 400, as shown in FIG. 13.

By vigorously shaking the developing-agent container 50 prior to fitting in the printer 100, even greater amount of air is incorporated in the premixed developing agent and even distribution of the toner and the carrier is improved. Fitting the developing-agent container 50 below the magnet 400 causes the carrier particles to be attracted by the magnet 400, thus causing an upward magnetic force to come into play in non-contact fashion on the carrier particles. While the toner particles in the developing-agent container 50 are subjected only to gravity, which acts in non-contact fashion, the carrier particles are subjected to gravitational force that acts downwards and a magnetic force that acts upwards. Due to the upward magnetic force, the downward force per unit volume of the carrier reduces, hence reducing the difference in the downward forces per unit volume of the carrier and the toner. The magnet 400 serves as a external-force applying unit.

Below the magnet 400, the difference in the downward forces per unit volume of the carrier and the toner due to the difference in the specific gravities of the carrier and the toner can be reduced, thus preventing the high specific gravity carrier particles from sinking faster than the low specific gravity toner particles.

In the third embodiment, the premixed developing agent in the developing-agent container 50 can be caused to settle while maintaining even distribution of the toner and the carrier due to the magnetic field formed by the magnet 400 by merely vigorously shaking the developing-agent container 50 prior to fitting it in the printer 100. As the toner and the carrier in the premixed developing agent in the developing-agent container 50 are evenly distributed, the developing agent supplied from the developing-agent container 50 to the developing unit 40 will have a steady toner-to-carrier ratio. Consequently, the concentration of the toner in the developing unit 40 is stabilized and the depleted carrier in the developing unit 40 is also replaced. As a result, good image quality can be sustained.

In the third embodiment, the external-force applying unit is provided in the form of the magnet 400 serving as a magnetic-field forming unit that causes an upward force to act on the carrier in the developing-agent container 50. In a second modification, the external-force applying unit is provided in the form of an electric-field forming unit that causes an upward force to act on the carrier.

Figure 14:
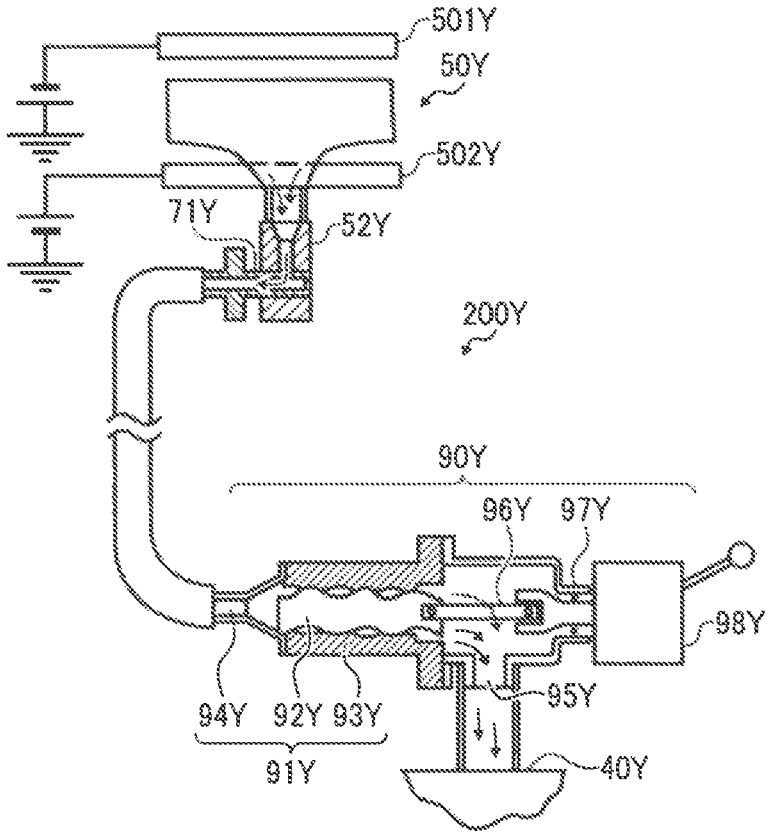
FIG. 14 is a schematic diagram of the developing-agent supplying device according to a second variation.

FIG. 14 is a drawing of the developing-agent supplying device 200 according to the second variation. In the developing-agent supplying device 200 according to the second variation, the upper electrode plate 501 is disposed above and the lower electrode plate 502 is fitted below the place where the developing-agent container 50 is fitted. A negative bias is applied to the upper electrode plate 501 and a positive bias is applied to the lower electrode plate 502, forming an electric field therebetween.

The developing-agent container 50 fitted in the printer 100 that includes the developing-agent supplying device 200 according to the third embodiment is filled with the premixed developing agent that includes toner and carrier, incorporated with air. The developing-agent container 50 is vigorously shaken so as to improve even distribution of the toner and the carrier in the premixed developing agent prior to be being fitted in the printer 100. When being fitted in the printer 100, the developing-agent container 50 is fitted between the upper electrode plate 501 and the lower electrode plate 502, as shown in FIG. 14.

By vigorously shaking the developing-agent container 50 prior to fitting in the printer 100, even greater amount of air is incorporated in the premixed developing agent and even distribution of the toner and the carrier is improved. When the premixed developing agent in the developing-agent container 50 is agitated due to vigorous shaking of the developing-agent container 50 prior to being fitted in the printer 100, the toner assumes a negative polarity whereas the carrier assumes a charge of positive polarity due to frictional electrification.

When the developing-agent container 50 is fitted between the upper electrode plate 501 and the lower electrode plate 502, the carrier particles that carry a positive polarity are repelled by the lower electrode plate 502 and attracted to the upper electrode plate 501. Thus, an upward force comes into play in non-contact fashion on the carrier particles. On the other hand, the toner particles that carry a negative polarity are repelled by the upper electrode plate 501 and attracted to the lower electrode plate 502. Thus, a downward force comes into play in non-contact fashion on the toner particles.

As the specific gravity of the carrier is greater than that of the toner, the downward force per unit volume of the carrier due to gravity is greater than that of the toner. In the electric field between the upper electrode plate 501 and the lower electrode plate 502, the electric field applies the upward force on the carrier, which is being pulled downward due to gravity. On the other hand, the electric field applies a downward force on the toner, which is being pulled downward due to gravity. In effect, the net downward force per unit volume of the carrier reduces, and the net upward force per unit volume of the toner increases, reducing the difference in the net downward forces per unit volume of the carrier and the toner. The upper electrode plate 501 and the lower electrode plate 502 form the electric-field forming unit and serve as the external-force applying unit.

The difference in gravitational forces per unit volume of the carrier and the toner in non-contact fashion due to the difference in the specific gravities of the carrier and toner is reduced between the upper electrode plate 501 and the lower electrode plate 502, thus preventing the high specific gravity carrier particles from sinking faster than the low specific gravity toner particles.

The developing-agent container 50 provided in the printer 100 according to the first to third embodiments and the first and second modifications includes a deformable bag portion 51 filled with the developing agent and is a flexible container that can discharge the developing agent and as a result shrink. As no agitating and conveying member can be provided inside such a flexible developing-agent container, once fitted in the printer 100, even distribution of the toner and the carrier in the developing agent in the developing-agent container 50 remains more or less unchanged after its bulk settles. If the toner and the carrier in the developing agent are evenly distributed after its bulk settles subsequent to being fitted in the printer 100, good image quality can be sustained.

In the embodiments described the developing-agent container 50 used is flexible. However, a rigid developing agent bottle that does not deform can also be used as the developing-agent container 50.

Even if an agitating member is provided for improving even distribution of the toner and the carrier in the premixed developing agent in the rigid developing agent bottle, the agitating member is not quite necessary as even distribution of the toner and the carrier in the premixed developing agent is sustained even without the agitating member. If the agitating member is provided for charging purposes, agitation of the premixed developing agent can be performed effectively as the premixed developing agent is agitated from a state of even distribution of the toner and the carrier.

Thus, according to the first embodiment, the developing-agent container 50 filled with the premixed developing agent D into which plenty of air is incorporated is made to traverse the magnetic field zone $\alpha$ for the length of time necessary for the premixed developing agent D to settle, where an upward force is applied on the carrier. Consequently, the high specific gravity carrier is prevented from sinking faster than the low specific gravity toner. Consequently, even distribution of the toner and the carrier in the developing agent can be prevented from degrading. By fitting the developing-agent container 50 manufactured by the method according to the first embodiment in the printer 100, the concentration of the toner in the developing unit 40 can be stabilized and the depleted carrier in the developing unit 40 is also replaced. As a result, good image quality can be sustained.

According to the first modification, the developing-agent container 50 filled with the premixed developing agent D into which plenty of air is incorporated is made to traverse the electric field zone $\beta$ for the length of time necessary for the bulk of the premixed developing agent D to settle, where an upward force is applied on the carrier while a downward force is applied on the toner. Consequently, the high specific gravity carrier is prevented from sinking faster than the low specific gravity toner. Consequently, even distribution of the toner and the carrier in the developing agent can be prevented from degrading.

According to the second embodiment, the toner particles in the premixed developing agent in the developing-agent container 50 have a plurality of bumps T1 on their surface. The carrier particles get entangled in the bumps T1 on the surface of the toner particles while gravitating downwards due to greater specific gravity by slipping through the gaps between the toner particles, and take the toner particles down along with them. Thus, the carrier is prevented from sinking to the bottom alone. The bulk of the premixed developing agent in the developing-agent container 50 settles while maintaining even distribution of the toner particles and the carrier particles. By fitting the developing-agent container 50 in the developing-agent supplying device 200, a developing agent with a steady toner-to-carrier ratio is conveyed to the developing unit 40. When the developing-agent supplying device 200 with the developing-agent container 50 according to the second embodiment is fitted in the printer 100, the steady concentration of the premixed developing agent being supplied stabilizes the concentration of the toner in the developing unit 40 and also replaces the depleted carrier in the developing unit 40. As a result, good image quality can be sustained.

According to the third embodiment, the developing-agent supplying device 200 includes the magnet 400, which is disposed above the developing-agent container 50 and which serves as a external-force applying unit that applies an upward force on the carrier in the developing-agent container 50 so as to reduce the difference in the forces per unit volume of the carrier and the toner. Consequently, the high specific gravity carrier is prevented from sinking faster than the low specific gravity toner. Even distribution of the toner and the carrier in the developing agent is prevented from degrading. Further, the bulk of the premixed developing agent in the developing-agent container 50 settles while maintaining even distribution of the toner particles and the carrier particles. By fitting the developing-agent supplying device 200 in the printer 100, a developing agent with a steady toner-to-carrier ratio is conveyed to the developing unit 40. When the developing-agent supplying device 200 with the developing-agent container 50 according to the second embodiment is fitted in the printer 100, the steady concentration of the premixed developing agent being supplied stabilizes the concentration of the toner in the developing unit 40 and also replaces the depleted carrier in the developing unit 40. As a result, good image quality can be sustained.

According to the second modification, the developing-agent supplying device 200 includes the upper electrode plate 501 disposed above the developing-agent container 50 and the lower electrode plate 502 disposed below the developing-agent container 50, and which together serve as a external-force applying unit that applies an upward force on the carrier in the developing-agent container 50 and a downward force on the toner so as to reduce the difference in the forces per unit volume of the carrier and the toner. Consequently, the high specific gravity carrier is prevented from sinking faster than the low specific gravity toner. Even distribution of the toner and the carrier in the developing agent is prevented from degrading. Further, the bulk of the premixed developing agent in the developing-agent container 50 settles while maintaining even distribution of the toner particles and the carrier particles.

As described above, according to one aspect of the present invention, high specific gravity particles are prevented from sinking faster than low specific gravity particles during the time when the bulk of the developing agent is settling by expelling the air included therein. Consequently, even distribution of the high specific gravity particles and the low specific gravity particles in the developing agent can be prevented from degrading.

As the specific gravities of the toner and the carrier in the developing agent varies, the force applied per unit volume of the toner and the carrier due to gravitation force also varies.

Furthermore, according to another aspect of the present invention, an external force is applied on either toner or carrier or both in the developing-agent container for the length of time required for the bulk of the developing agent in the developing-agent container to settle so as to reduce the difference in the downward forces per unit volume of the carrier and the toner due to gravity. Consequently, the high specific gravity particles can be prevented from sinking faster than the low specific gravity particles.

Moreover, according to still another aspect of the present invention, an external force is applied on either the toner or the carrier or both in the developing-agent container by a external-force applying unit, so as to reduce the difference between the forces per unit volume of the toner and the carrier due to gravity. Consequently, the high specific gravity particles can be prevented from sinking faster than the low specific gravity particles.

Furthermore, according to still another aspect of the present invention, the toner particles or the carrier particles or both have a plurality of bumps on the surface, so that when the carrier particles or toner particles slip through the gaps between the toner particles or the carrier particles they get entangled in the bumps. When the high specific gravity particles are gravitating downwards, they take the low specific gravity particles with them. Consequently, the high specific gravity particles are prevented from sinking faster than the low specific gravity particles.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of manufacturing a developing-agent container for containing developing agent including toner and carrier to be supplied to a developing unit, the method comprising:

filling the developing-agent container with the developing agent with the toner and the carrier evenly distributed in a highly air-containing state; and applying, after filling the developing-agent container with the developing agent, an external force on at least one of the toner and the carrier in the toner container so that a difference in forces per unit volume of the toner and the carrier due to gravity becomes small.

2. The method according to claim 1, wherein the carrier has a greater specific gravity than the toner, and the applying includes forming a magnetic field that applies an upward force on the carrier.

3. The method according to claim 1, wherein the carrier has a greater specific gravity than the toner, and the applying includes forming an electric field that applies an upward force on the carrier.

4. The method of manufacturing the developing-agent container according to claim 1, further comprising:

agitating the developing agent for a predetermined amount of time.

5. The method of manufacturing the developing-agent container according to claim 1, further comprising:

mounting the developing-agent container on a conveyor belt such that the developing-agent container traverses a magnetic field zone of a magnet disposed proximate to the conveyor belt; and allowing the developing-agent container to traverse the magnetic field zone for a predetermined amount of time.

6. The method of manufacturing the developing-agent container according to claim 5, wherein the predetermined amount of time is approximately 10 minutes.

7. The method of manufacturing the developing-agent container according to claim 1, further comprising:

mounting the developing-agent container on a conveyor belt such that the developing-agent container traverses an electric field zone formed by an upper electrode plate and a lower electrode plate disposed proximate to the conveyor belt; and allowing the developing-agent container to traverse the electric field zone for a predetermined amount of time.

8. The method of manufacturing the developing-agent container according to claim 7, wherein the predetermined amount of time is approximately 10 minutes.

9. A developing-agent supplying device for supplying developing agent that contains toner and carrier contained in a developing-agent container to a developing unit that develops an electrostatic latent image formed on a latent image carrier to form a toner image, the developing-agent supplying device comprising:

an external-force applying unit that applies an external force to at least one of the toner and the carrier in the developing-agent container so that a difference in forces per unit volume of the toner and the carrier due to gravity becomes small.

10. The developing-agent supplying device according to claim 9, wherein the carrier has a greater specific gravity than the toner, and the external-force applying unit includes a magnetic-field forming unit that forms a magnetic field that applies an upward force on the carrier.

11. The developing-agent supplying device according to claim 10, wherein the magnetic-field forming unit is a permanent magnet provided on an upper side of the developing-agent container.

12. The developing-agent supplying device according to claim 10, wherein the magnetic-field forming unit is an electromagnet provided on an upper side of the developing-agent container.

13. The developing-agent supplying device according to claim 9, wherein the carrier has a greater specific gravity than the toner, and the external-force applying unit includes an electric-field forming unit that forms an electric field that applies an upward force on the carrier.

14. The developing-agent supplying device according to claim 9, wherein the developing-agent container includes a bag portion that contains the developing agent, and a capacity of the developing-agent container decreases by deforming the bag portion by applying external pressure or reducing internal pressure.

15. An image forming apparatus, comprising:

a latent image carrier on which an electrostatic latent image is formed;

a developing unit that develops the electrostatic latent image formed on the latent image carrier to form a toner image; and the developing-agent supplying device according to claim 9.

16. The developing-agent supplying device according to claim 9, wherein at least one of the toner and the carrier has a plurality of bumps on a particle surface thereof.

17. The developing-agent supplying device according to claim 16, wherein the toner has the plurality of bumps on the particle surface thereof, and a shape factor SF-2 of a particle of the toner is equal to or larger than 110.

18. The developing-agent supplying device according to claim 16, wherein the carrier has the plurality of bumps on the particle surface thereof, and a shape factor SF-2 of a particle of the carrier is equal to or larger than 110.

19. The developing-agent supplying device according to claim 16, wherein the developing-agent container includes a bag portion that contains the developing agent, and a capacity of the developing-agent container decreases by deforming the bag portion by applying external pressure or reducing internal pressure.

20. An image forming apparatus, comprising:

the developing-agent supplying device according to claim 16.

* * * * *